US010844863B2

(12) United States Patent
Yamashita

(10) Patent No.: US 10,844,863 B2
(45) Date of Patent: Nov. 24, 2020

(54) CENTRIFUGAL ROTARY MACHINE

(71) Applicant: MITSUBISHI HEAVY INDUSTRIES COMPRESSOR CORPORATION, Tokyo (JP)

(72) Inventor: Shuichi Yamashita, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 98 days.

(21) Appl. No.: 16/079,319

(22) PCT Filed: Feb. 28, 2017

(86) PCT No.: PCT/JP2017/007895
§ 371 (c)(1),
(2) Date: Aug. 23, 2018

(87) PCT Pub. No.: WO2017/150554
PCT Pub. Date: Sep. 8, 2017

(65) Prior Publication Data

US 2019/0055947 A1 Feb. 21, 2019

(30) Foreign Application Priority Data

Feb. 29, 2016 (JP) ..... 2016-038406

(51) Int. Cl.
*F04D 29/44* (2006.01)
*F04D 17/10* (2006.01)
*F04D 17/12* (2006.01)

(52) U.S. Cl.
CPC ..... *F04D 17/10* (2013.01); *F04D 17/122* (2013.01); *F04D 29/44* (2013.01); *F04D 29/444* (2013.01)

(58) Field of Classification Search
CPC . F04D 17/122; F04D 29/444; F05D 2240/121
See application file for complete search history.

(56) References Cited

U.S. PATENT DOCUMENTS 2,300,766 A * 11/1942 Baumann ..... F04D 29/462 415/149.1
4,087,200 A * 5/1978 Korenblit ..... F04D 17/125 415/199.2

(Continued)

FOREIGN PATENT DOCUMENTS

DE 1428161 A1 1/1969
JP S62-059796 U 4/1987

(Continued)

OTHER PUBLICATIONS

International Search Report for corresponding International Application No. PCT/JP2017/007895, dated Jun. 6, 2017 (2 pages).

(Continued)

*Primary Examiner* — Ninh H. Nguyen
(74) *Attorney, Agent, or Firm* — Osha Bergman Watanabe & Burton LLP

(57) ABSTRACT

The centrifugal compressor includes an impeller configured to feed a fluid suctioned from one side to an outside in a radial direction by rotating about an axis, and a flow path provided between the impellers adjacent to each other in the direction of an axis and configured to guide the fluid discharged from an impeller on the upstream side to an impeller on the downstream side. The flow path includes a diffuser flow path, a return bend portion, and a guide flow path. Further, the centrifugal compressor further includes return vanes extending across the return bend portion and the guide flow path in the flow path and provided in intervals in a circumferential direction, and the radial positions of the leading edges of the return vanes in the flow paths adjacent in the direction of the axis are different from each other.

6 Claims, 5 Drawing Sheets

(56) References Cited

U.S. PATENT DOCUMENTS

| | | | | |
|---|---|---|---|---|
| 4,938,661 | A * | 7/1990 | Kobayashi | F04D 29/444 415/199.1 |
| 2015/0308453 | A1 | 10/2015 | Nakaniwa et al. | |
| 2018/0156059 | A1* | 6/2018 | Toni | F01D 5/043 |

FOREIGN PATENT DOCUMENTS

| | | | |
|---|---|---|---|
| JP | H10-331793 | A | 12/1998 |
| JP | H11-173299 | A | 6/1999 |
| WO | 2010061512 | A1 | 6/2010 |
| WO | 2014115417 | A1 | 7/2014 |

OTHER PUBLICATIONS

Written Opinion for corresponding International Application No. PCT/JP2017/007895, dated Jun. 6, 2017 (9 pages).

* cited by examiner

CENTRIFUGAL ROTARY MACHINE

TECHNICAL FIELD

The present invention relates to a centrifugal rotary machine.

This application claims priority right to Japanese Patent Application No. 2016-038406 filed in Japan on Feb. 29, 2016, the content of which is incorporated herein by reference.

BACKGROUND TECHNOLOGY

A rotary machine such as a centrifugal compressor used for industrial use mainly includes an impeller that rotates about an axis and a casing that covers an outer peripheral side of the impeller and forms a fluid flow path between the casing and the impeller. The flow path includes a diffuser flow path extending to an outside in a radial direction of the axis from an impeller, a return bend portion provided at a downstream side of the diffuser flow path and guiding a flow of fluid from the outside toward the inside in the radial direction and a guide flow path provided at the downstream side of the return bend portion and guiding a fluid to the downstream side of the impeller. Furthermore, a return vane may be provided on the guide flow path for the purpose of rectification.

As a specific example of a centrifugal compressor including such a return vane, a centrifugal compressor disclosed in Patent Document 1 below is known. In particular, in the centrifugal compressor according to Patent Document 1, an upstream end (leading edge) of the return vane protrudes toward the return bend portion side. According to such a configuration (hereinafter referred to as a "protruding return vane"), high efficiency of the centrifugal compressor can be achieved.

PRIOR ART DOCUMENT

[Patent Document]

[Patent Document 1] Japanese Unexamined Patent Publication No. H10-331793.

SUMMARY OF THE INVENTION

Problems to be Solved by the Invention

Such a protruding return vane is effective in the case where the flow rate of a fluid at the return bend portion is relatively high and separation of a flow easily occurs around the return bend portion.

However, when the flow rate of a fluid at the return bend portion is low (the mechanical Mach number is small) and the separation of a flow does not easily occur, not only can a sufficient effect not be obtained but the flow of the fluid may also be hindered by an increase in the friction loss.

In a centrifugal compressor having a plurality of pressure stages, a machine Mach number is high at a front stage and a machine Mach number becomes low while directed toward a rear stage. Therefore, it is not appropriate to provide the above-described return vane for all pressure stages. In this way, there is an increasing demand for a centrifugal compressor which is capable of sufficiently high efficiency in a wide flow velocity range.

The present invention is provided to solve the above problems, and an object of the present invention is to provide a centrifugal rotary machine capable of sufficiently high efficiency in a wide flow velocity range.

Means for Solving the Problem

A first aspect of the present invention provides a centrifugal rotary machine comprising: a plurality of impellers that are arranged in an axial direction and that are configured to feed a fluid suctioned from one side in the direction of the axis to the outside in the radial direction of the axis by rotating about the axis; and a flow path provided between the impellers adjacent to each other in the axial direction, and configured to guide the fluid discharged from an upstream impeller to a downstream impeller, wherein the flow path includes: a diffuser flow path configured to guide the fluid discharged from the upstream impeller to the outside in the radial direction; a return bend portion configured to guide the fluid guided by the diffuser flow path toward the inside in the radial direction; a guide flow path configured to guide the fluid guided by the return bend portion to the inside in the radial direction and to introduce the fluid to the impeller on the other side in the axial direction; and a plurality of return vanes extending across the return bend portion and the guide flow path in the flow path and disposed at intervals in a circumferential direction, wherein radial positions of leading edges of the return vanes in the flow paths adjacent to each other in the axial direction are different from each other.

According to this configuration, in the return vane in which the position of the leading edge is positioned relatively at the outside in the radial direction, it is possible to suppress the separation of the flow when the fluid passes through the return bend portion. On the other hand, in the return vane in which the position of the leading edge is located relatively at the inside in the radial direction, it is possible to suppress an increase in friction loss when the fluid flows through the return vane.

In other words, in the region where the mechanical Mach number of the fluid is large, a return vane whose leading edge position is located relatively at the outside in the radial direction is provided, and in the region where the mechanical Mach number of the fluid is small, a return vane whose position of the leading edge is relatively positioned at the inside in the radial direction is provided, so that it is possible to reduce the separation of the flow and suppress of the friction loss in a well-balanced manner in the centrifugal rotary machine having a plurality of different flow velocity ranges.

A second aspect of the present invention provides the centrifugal rotating machine according to the first aspect, wherein the radial position of the leading edge of the subsequent return vane on the other side in the axial direction may be disposed in the inside in the radial direction.

According to this configuration, for example, in the centrifugal rotary machine in which the mechanical Mach number is smaller toward the other side in the axial direction (downstream side), the radial position of the leading edge of the subsequent return vane in the downstream side is disposed in the inside in the radial direction, so that the separation of the flow on the upstream side can be reduced and the friction loss can be suppressed on the downstream side.

A third aspect of the present invention provides the centrifugal rotary machine according to the first aspect, wherein the radial position of the leading edge of the subsequent return vane in the other side in the axial direction may be disposed in the outside in the radial direction.

According to this configuration, for example, in a centrifugal rotary machine in which the mechanical Mach number is larger toward the other side in the axial direction (downstream side), the radial position of the leading edge of the subsequent return vane on the downstream side is disposed in the outside in the radial direction, so that the friction loss can be suppressed on the upstream side, and on the other hand, the separation of the flow can be reduced on the downstream side.

A fourth aspect of the present invention provides the centrifugal rotary machine according to any one of the first to third aspects, wherein the leading edge may be parallel to the axis.

According to this configuration, it is possible to sufficiently suppress the separation of the flow at the return bend portion, and to reduce the possibility of friction loss occurring in the fluid due to the return vane.

A fifth aspect of the present invention provides the centrifugal rotary machine according to any one of the first to third aspects, wherein in the subsequent return vane in the other side in the axial direction, an inner peripheral-side end portion located on an inner peripheral side of the return bend portion among the end portions of the leading edge on both sides in the axial direction may be located on the guide flow path side, and the outer peripheral-side end portion located on the outer peripheral side of the inner peripheral-side end portion may be located on the inside in the radial direction as compared with the inner peripheral-side end portion with respect to the axis.

According to this configuration, the inner peripheral-side end portion at the leading edge of the return vane is located on the guide flow path side, and the outer peripheral-side end portion is located on the inside in the radial direction as compared with the inner peripheral-side end portion. As a result, it is possible to more effectively suppress the separation at the inner peripheral side of the return bend portion where the separation of the flow is most likely to occur, and to sufficiently suppress an increase in the friction loss at the outer peripheral side.

In addition, since, in the subsequent return vane in the other side in the axial direction, the inner peripheral-side end portion is located on the guide flow path side, for example, in a centrifugal rotary machine in which the machine Mach number increases on the upstream side, the separation of the flow can be suppressed on the upstream side, while the friction loss can be suppressed on the downstream side.

A sixth aspect of the present invention provides the centrifugal rotary machine according to any one of the first to third aspects, wherein in the subsequent return vane in the other side in the axial direction, the inner peripheral-side end portion located on the inner peripheral side of the return bend portion among the end portions of the leading edge on both sides in the axial direction may be located on the return bend portion side, and the outer peripheral-side end portion located on the outer peripheral side of the inner peripheral-side end portion may be located on the outside in the radial direction as compared with the inner peripheral-side end portion with respect to the axis.

According to this configuration, in the subsequent return vane in the other side in the axial direction, the inner peripheral-side end portion at the leading edge of the return vane is located on the guide flow path side, and the outer peripheral-side end portion is located on the inside in the radial direction as compared with the inner peripheral-side end portion. As a result, it is possible to more effectively suppress the separation at the inner peripheral side of the return bend portion where the separation of the flow is most likely to occur, and to sufficiently suppress an increase in the friction loss at the outer peripheral side.

In addition, since, in the subsequent return vane in the other side in the axial direction, the inner peripheral-side end portion is located on the return bend portion side, for example, in a centrifugal rotary machine in which the machine Mach number increases on the downstream side, the friction loss can be suppressed on the upstream side and the separation of the flow can be suppressed on the downstream side.

A seventh aspect of the present invention provides the centrifugal rotary machine according to the fifth or sixth aspect, wherein the leading edge may extend so as to incline from the outside to the inside in the radial direction with respect to the axis while directed toward the outer peripheral-side end portion from the inner peripheral-side end portion.

According to this configuration, since the leading edge of the return vane extends so as to incline from the outside to the inside in the radial direction with respect to the axis while directed toward the outer peripheral-side end portion from the inner peripheral-side end portion, it is possible to obtain a rectifying effect of the flow of the fluid on the inner peripheral side of the return bend portion.

Effect of Invention

The object of the present invention is to provide a centrifugal rotary machine capable of sufficiently high efficiency in a wide flow velocity range.

MODE FOR CARRYING OUT THE INVENTION

First Embodiment

Figure 1:
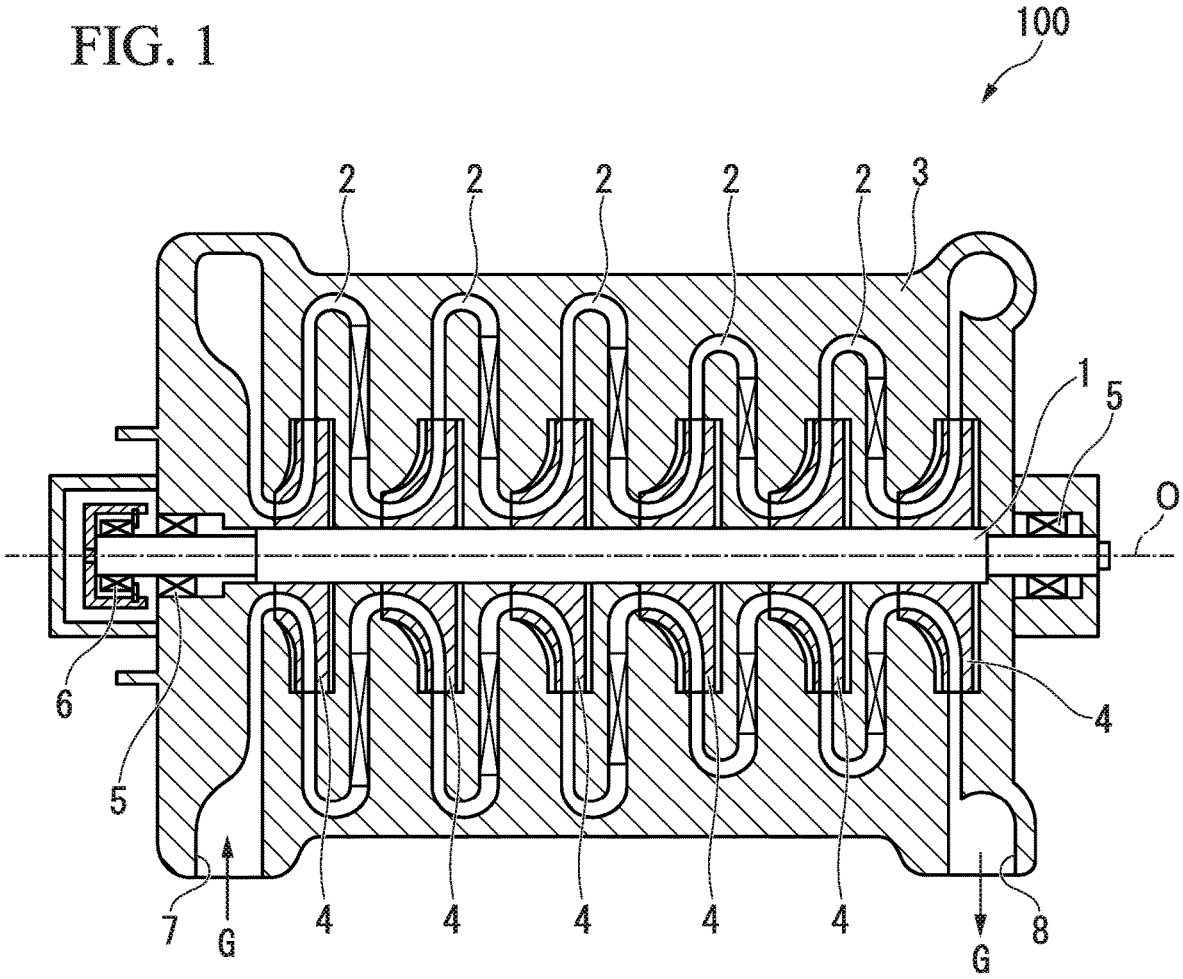
FIG. 1 is a schematic diagram showing a configuration of a centrifugal compressor according to each embodiment of the present invention.

Hereinafter, a centrifugal compressor 100 (a centrifugal rotary machine) according to a first embodiment of the present invention will be described with reference to FIG. 1 and FIG. 2. As shown in FIG. 1, the centrifugal compressor 100 includes a rotor 1 that rotates about an axis O thereof, a casing 3 that covers the rotor 1 and forms a flow path 2, and a plurality of impellers 4 that are provided on the rotor 1.

The casing 3 has a cylindrical shape extending substantially along the axis O. The rotor 1 extends so as to penetrate an inside of the casing 3 along the axis O. A journal bearing 5 and a thrust bearing 6 are provided at both end portions of the casing 3 in a direction of the axis O (axial direction). The rotor 1 is supported by the journal bearing 5 and the thrust bearing 6 so as to be rotatable about the axis O.

On one side of the casing 3 in the direction of the axis O, an intake port 7 for taking in air as a working fluid G from the outside is provided. Further, an exhaust port 8 that exhausts the working fluid G compressed in the inside of the casing 3 is provided on the other side of the casing 3 in the direction of the axis O.

Inside the casing 3, an internal space which communicates with the intake port 7 and the exhaust port 8 and has a shape in which the diameter repeatedly increases and decreases along its path is formed. This internal space accommodates a plurality of impellers 4 and forms part of the above-described flow path 2. In the following description, the side on which the intake port 7 is located on the flow path 2 will be referred to as an upstream side, and the side on which the exhaust port 8 is located will be referred to as a downstream side.

A plurality of (six) impellers 4 are provided on the rotor 1 at intervals in the direction of the axis O on an outer peripheral surface thereof. As shown in FIG. 2, each of the impellers 4 includes a disk 41 having a substantially circular cross section when viewed from the direction of the axis O, a plurality of vanes 42 provided on an upstream side of the disk 41, and a shroud 43 covering the plurality of vanes 42 from an upstream side thereof.

When viewed from the direction intersecting with the axis O, the disk 41 has a substantially conical shape by being formed so that a size in the radial direction gradually expands from one side toward the other side in the direction of the axis O.

A plurality of vanes 42 are arranged in a radial manner on a conical surface facing the upstream side of both surfaces of the disk 41 in the direction of an axis O and radially outward with the axis O as the center. More specifically, each of the vanes 42 is formed of a thin plate erected from an upstream surface of the disk 41 toward an upstream side. Further, although not shown in detail, these plurality of vanes 42 are curved so as to be directed from one side to the other side in the circumferential direction when viewed from the direction of the axis O.

A shroud 43 is provided at an upstream end edge of the vane 42. In other words, the plurality of vanes 42 are substantially held by the shroud 43 and the disk 41 in the direction of the axis O. As a result, a space is formed between the shroud 43, the disk 41, and the pair of the vanes 42 adjacent to each other. This space forms part of the flow path 2 (a compression flow path 22) to be described later.

The flow path 2 is a space that communicates the impeller 4 configured as described above with the internal space of the casing 3. In this embodiment, it is assumed that one flow path 2 is formed for each impeller 4 (each compression stage). In other words, in the centrifugal compressor 100, five flow paths 2 which are continuous from the upstream side toward the downstream side are formed to correspond to the five impellers 4 except for the impeller 4 at the last stage.

Each of the flow paths 2 has an intake flow path 21, a compression flow path 22, a diffuser flow path 23, a return bend portion 24, and a guide flow path 25. In addition, FIG. 2 mainly shows the impellers 4 from the first stage to the third stage out of the flow path 2 and the impellers 4.

In the first stage impeller 4, the intake flow path 21 is substantially directly connected to the intake port 7. By this intake flow path 21, external air is taken into each flow path on the flow path 2 as the working fluid G. More specifically, the intake flow path 21 gradually curves toward the outside in the radial direction from the axis O while directed toward the downstream side from the upstream side.

The intake flow path 21 in the impellers 4 of the second and subsequent stages communicates with a downstream end of the guide flow path 25 (to be described later) in the flow path 2 in the previous stage (first stage). In other words, the flow direction of the working fluid G that has passed through the guide flow path 25 is changed so as to be directed toward the downstream side along the axis O in the same manner as described above.

The compression flow path 22 is a flow path surrounded by a surface on an upstream side of the disk 41, a surface on a downstream side of the shroud 43, and a pair of vanes 42 adjacent to each other in the circumferential direction. More specifically, the cross-sectional area of the compression flow path 22 gradually decreases from the inside to the outside in the radial direction. Thus, the working fluid G flowing through the compression flow path 22 in a state in which the impeller 4 is rotating is gradually compressed into a high pressure fluid.

The diffuser flow path 23 is a flow path extending from the inside to the outside in the radial direction of the axis O by being surrounded by the diffuser front wall 23A that is part of the inner peripheral wall of the casing 3 and the diffuser rear wall 23B of a partition wall member 31. An end portion of the diffuser flow path 23 on the inside in the radial direction communicates with an end portion of the compression flow path 22 on the outside in the radial direction.

In addition, the partition wall member 31 is a member that partitions between the plurality of the impellers 4 adjacent to each other in the direction of the axis O by being integrally provided on an inner peripheral side of the casing 3. Further, when viewed from the partition wall member 31, an extension portion 32 that is also integrally provided with the casing 3 is provided on the upstream side with the diffuser flow path 23 and the impeller 4 being interposed. The extending portion 32 is a wall portion extending toward the inside in the radial direction from an inner peripheral surface (not shown) of the casing 3.

The return bend portion 24 is a curved flow path surrounded by an inversion wall 33 of the casing 3 and an outer peripheral wall 31A of the partition wall member 31. One end side (upstream side) of the return bend portion 24 is communicated with the diffuser flow path 23, and the other end side (downstream side) is communicated with the guide flow path 25. In addition, a boundary position between the return bend portion 24 and the diffuser flow path 23 is set at a position P1 at which the return bend portion 24 starts to be curved when viewed from an upstream side of the flow path 2.

The return bend portion 24 reverses the flow direction of the working fluid G flowing from the inside toward the outside in the radial direction via the diffuser flow path 23. In a middle portion of the return bend portion 24, a portion located at the outermost side in the radial direction is defined as a top portion T. In the vicinity of the top portion T, the inner wall surface of the return bend portion 24 forms a three dimensional curved surface so as not to prevent the flow of the working fluid G.

The guide flow path 25 is a flow path surrounded by the downstream-side wall 31B of the partition wall member 31 in the casing 3 and the upstream-side wall 32A of the extension portion 32. The end portion of the guide flow path 25 on the outside in the radial direction communicates with the return bend portion 24. A boundary position between the return bend portion 24 and the guide flow path 25 is set at a position P2 at which the bend of the return bend portion 24 is terminated.

Further, the end portion of the guide flow path 25 on the inside in the radial direction communicates with the intake flow path 21 in the flow path 2 at a later stage as described above.

Further, a plurality of return vanes 50 are provided in the guide flow path 25. The plurality of return vanes 50 are arranged in a radial manner centered on the axis O in the guide flow path 25. In other words, these return vanes 50 are arranged in the circumferential direction at intervals around the axis O. Specifically, each return vane 50 is formed of a plate member extending from the downstream-side lateral wall 31B of the partition wall member 31 toward the upstream-side lateral wall 32A of the extension portion 32.

Figure 2:
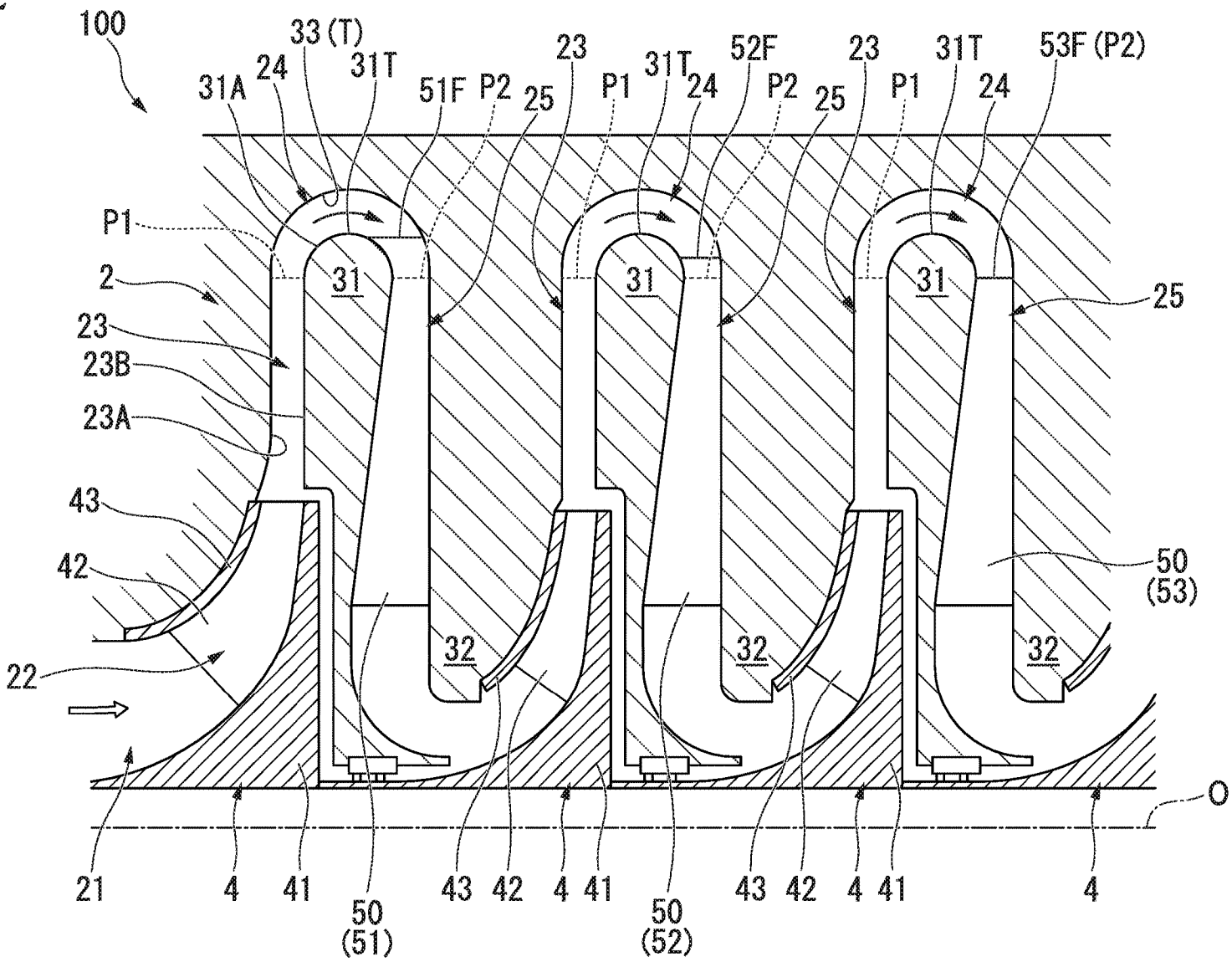
FIG. 2 is an enlarged cross-sectional view of an essential portion of a centrifugal compressor according to a first embodiment of the present invention.

In addition, as shown in FIG. 2, in the centrifugal compressor 100 according to the present embodiment, the shapes and the sizes of the return vanes 50 are different between the upstream side and the downstream side of the flow path 2. In the following description, the return vane 50 located on the most upstream side will be referred to as the first return vane 51, and the two return vanes 50 provided adjacent to the downstream side of the first return vane will be referred to as the second return vane 52 and the third return vane 53 in that order.

Further, in this embodiment, an example in which the return vanes 50 are each provided in only the three flow paths 2 counted from the most upstream side, and the return vanes 50 are not provided in the two flow paths 2 in the downstream side is described. However, it is also possible to provide return vanes 50 in all of the flow paths 2.

The leading edge of each return vane 50 (the first return vane 51, the second return vane 52, and the third return vane 53) is parallel to the axis O. In addition, the term "parallel" does not necessarily mean strictly parallel, and slight manufacturing errors, tolerances, and the like are permissible insofar as they are intended to be substantially parallel.

In the centrifugal compressor 100, the radial positions of the leading edges (the edges facing the upstream side on the flow path 2) differ from each other while directed from the first return vane 51 toward the third return vane 53. More specifically, the leading edge 51F of the first return vane 51 is provided at a position corresponding to an outermost peripheral portion 31T of the outer peripheral wall 31A in the radial direction of the axis O. Here, the outermost peripheral portion 31T refers to a peripheral edge of the outer peripheral wall 31A of the partition wall member 31 that is located on the outermost side in the radial direction with respect to the axis O.

The leading edge 51F of the first return vane 51 forms a straight line connecting the outermost peripheral portion 31T and a point on the upstream-side lateral wall 32A located on the other side of the outermost peripheral portion 31T in the direction of the axis O.

The size of the first return vane 51 in the direction of the axis O is temporarily reduced toward a position corresponding to the position P2 on the inside in the radial direction from the leading edge 51F. On the other hand, further inside in the radial direction as compared with the position P2, the size of the first return vane 51 in the direction of the axis O gradually increases from the outside in the radial direction toward the inside in the radial direction. In the following description, in each of the return vanes 50, a portion on the outside in the radial direction of a straight line connecting the position P1 and the position P2 may be referred to as a protruding portion 50P. In other words, when viewed from the side of the guide flow path 25, the protruding portion 50P forms part of the return vane 50 that protrudes toward the return bend portion 24.

The leading edge 52F of the second return vane 52 is provided in a region between an outermost peripheral portion 31T and the above-described position P2 in a radial direction of the axis O. In this embodiment, as an example, the leading edge 52F is located on a line equally dividing the region between the outermost peripheral portion 31T and the position P2. Similarly to the first return vane 51, in the second return vane 52, the size in the direction of the axis O is temporarily reduced while directed from the leading edge 52F toward the position P2 on the inside in the radial direction. On the other hand, further inside in the radial direction as compared with the position P2, the size of the second return vane 52 in the direction of the axis O gradually increases from the outside in the radial direction toward the inside in the radial direction. Further, the size of the protruding portion 50P of the second return vane 52 (i.e., the size in the radial direction of the axis) is smaller than the size of the protruding portion 50P of the first return vane 51.

The leading edge 53F of the third return vane 53 is provided at a position corresponding to the position P2 in the radial direction of the axis O. That is, the third return vane 53 does not have the protruding portion 50P. Further, the third return vane 53 is formed so that the size in the direction of the axis O gradually increases from the leading edge 53F toward the inside in the radial direction so as to correspond to the cross-sectional shape of the guide flow path 25.

Next, an operation of the centrifugal compressor 100 according to the present embodiment will be described.

In the centrifugal compressor 100 which is in a normal operating state, the working fluid G behaves as follows.

First, the working fluid G taken into the flow path 2 from the intake port flows into the compression flow path 22 in the impeller 4 via the intake flow path 21 of the first stage. Since the impeller 4 rotates about the axis O with the rotation of the rotor 1, a centrifugal force is applied to the working fluid G in the compression flow path 22 from the axis O toward the outside in the radial direction. In addition, as described above, since the cross-sectional area of the compression flow path 22 gradually decreases from the outside to the inside in the radial direction, the working fluid G is gradually compressed. Thus, the high-pressure working fluid G is sent out from the compression flow path 22 into the subsequent diffuser flow path 23.

The high-pressure working fluid G flowing out of the compression flow path 22 then passes through the diffuser flow path 23, the return bend section 24, and the guide flow path 25 in that order. Thereafter, similar compression is also applied in the impeller 4 and the flow path 2 of the second and subsequent stages. Finally, the working fluid G is supplied from the exhaust port 8 to an external device (not shown) in a desired pressure state.

Here, in the centrifugal compressor 100 having a plurality of compression stages as described above, the flow velocity of the fluid in the flow path 2 is higher in the compression stage on the upstream side (with a larger mechanical Mach number), and the flow velocity of the fluid in the flow path 2 is lower in the compression stage on the downstream side (with a smaller mechanical Mach number).

Therefore, there is a possibility of the separation of the flow occurring due to a relatively high flow velocity on an inner peripheral side of the return bend portion 24 in the flow path 2 on the most upstream side. However, in the centrifugal compressor 100 according to the present embodiment, the leading edge 51F of the first return vane 51 provided in the compression stage (flow path 2) on the most upstream side has the protruding portion 50P. When viewed from the side of the guide flow path 25, the protruding portion 50P protrudes toward the return bend 24. As a result, it is possible to reduce the possibility of the separation of the flow at the inner peripheral side of the return bend portion 24.

On the other hand, in the second return vane 52 located at the downstream side of the first return vane 51, the protruding amount of the protruding portion 50P is reduced as compared with that of the first return vane 51. In other words, in the second return vane 52, a leading edge 52F thereof is provided in a region between an outermost peripheral portion 31T and the above-described position P2 in the radial direction of the axis O.

Further, the protruding portion 50P is not formed in the third return vane 53 that is provided adjacent to the downstream side of the second return vane. In other words, the leading edge 53F of the third return vane 53 is provided at a position corresponding to the position P2 in the radial direction of the axis O.

In this way, on the downstream side with a relatively low flow velocity, the second return vane 52 and the third return vane 53 do not have the protruding portion 50P, and thereby it is possible to reduce the possibility of the occurrence of friction loss in the flow.

As described above, in the centrifugal compressor 100 according to the present embodiment, in the return vane 50 (the first return vane 51) in which the position of the leading edge 51F is positioned relatively on the outside in the radial direction, it is possible to suppress the separation of the flow flowing through the return bend portion 24. On the other hand, in the return vanes 50 (the second return vane 52 and the third return vane 53) in which the positions of the leading edges 52F and 53F are positioned relatively on the inside in the radial direction, it is possible to suppress an increase in friction loss when the fluid flows.

In other words, in an upstream region in which the mechanical Mach number of the fluid is large, a return vane 50 in which the position of the leading edge is located relatively on the outside in the radial direction is provided, and in a region in which the mechanical Mach number of the fluid is small, a return vane 50 in which the position of the leading edge is positioned relatively on the inside in the radial direction is provided, whereby it is possible to reduce the separation of the flow and to suppress the frictional loss in a well-balanced manner in a plurality of different flow velocity ranges. Therefore, it is possible to provide a centrifugal compressor 100 capable of sufficiently high efficiency in a wide flow velocity range.

Second Embodiment

Next, a second embodiment of the present invention will be described with reference to FIG. 3. In addition, the same components as in the first embodiment will be denoted by the same reference numerals, and a detailed description thereof will be omitted.

Figure 3:
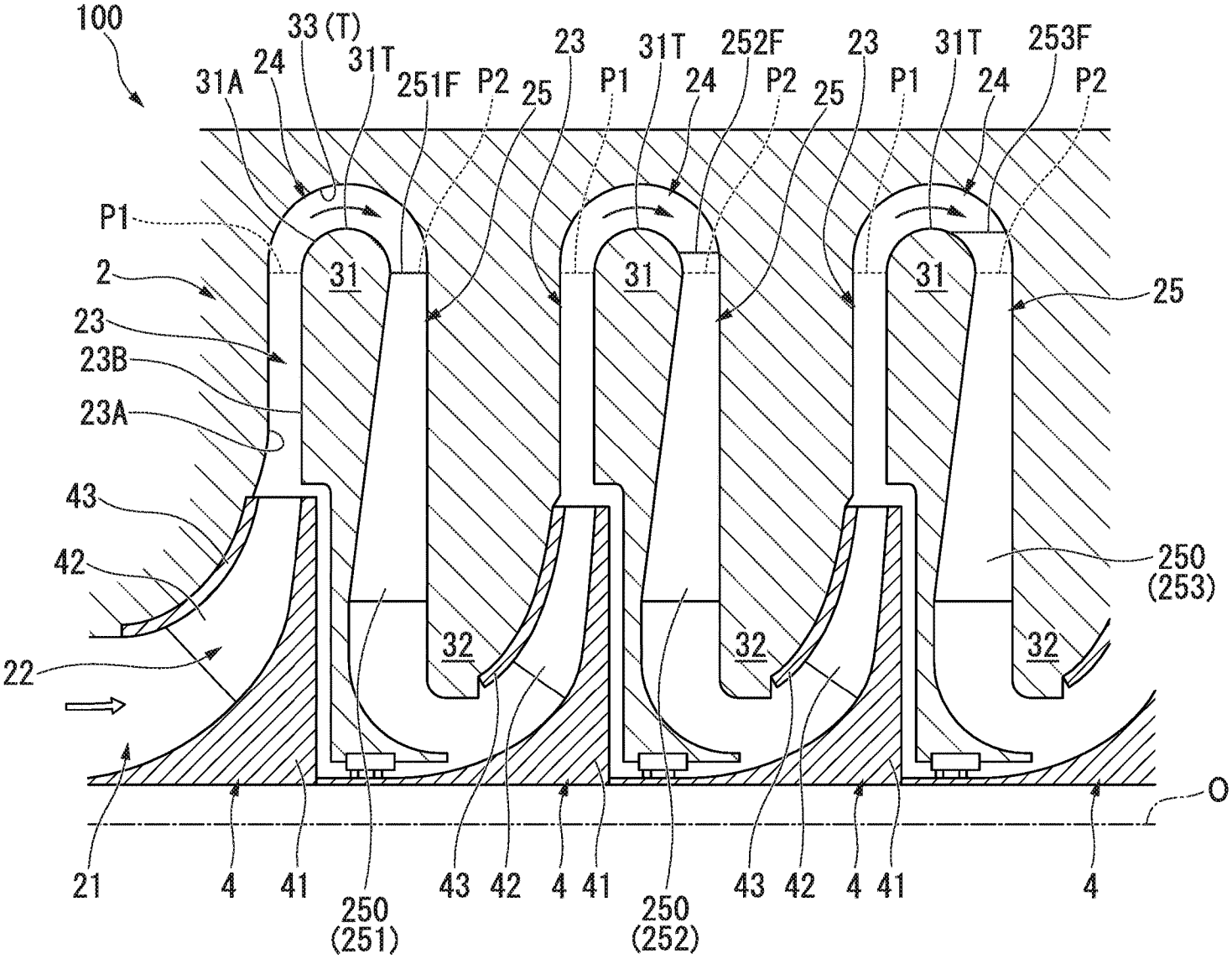
FIG. 3 is an enlarged cross-sectional view of an essential portion of a centrifugal compressor according to a second embodiment of the present invention.

As shown in FIG. 3, in the centrifugal compressor 200 according to the present embodiment, the leading edges 251F, 252F, and 253F of the return vanes 250 (the first return vane 251, the second return vane 252, and the third return vane 253) in the radial direction of the axis O are sequentially positioned on the outside in the radial direction in the subsequent return vane 250 in the downstream side. Similarly to the first embodiment, in any of the return vanes 250, the leading edges 251F, 252F, and 253F extend in a direction parallel to the direction of the axis O.

In the first return vane 251, a radial position of the leading edge 251F is defined as the position P2 in the first embodiment described above. In the second return vane 252, a radial position of the leading edge 252F is defined between the position P2 and an outermost peripheral portion 31T. Further, in the third return vane 253, a radial position of the leading edge 253F is a position corresponding to the outermost circumferential portion 31T.

Further, in the centrifugal compressor 200 according to the present embodiment, unlike the centrifugal compressor 100 according to the first embodiment, the flow velocity of the fluid flowing through the flow path 2 gradually increases from the upstream side toward the downstream side (i.e., the mechanical Mach number gradually increases).

According to the above configuration, in the centrifugal compressor 200 in which the mechanical Mach number becomes larger toward the other side (downstream side) in the direction of the axis O, since the radial position of the leading edge of the subsequent return vanes 250 in the downstream side is located on the outside in the radial direction, the friction loss can be suppressed at the return vane 250 at the upstream side, while the separation of the flow can be reduced at the return vane 250 at the downstream side.

In other words, in an upstream region in which the mechanical Mach number of the fluid is small, a return vane 250 in which the position of the leading edge is positioned relatively on the inside in the radial direction is provided, and in a region in which the mechanical Mach number of the fluid is large, a return vane 250 in which the position of the leading edge is positioned relatively on the outside in the radial direction is provided, whereby it is possible to reduce the separation of the flow and suppress of the frictional loss in a well-balanced manner in a plurality of different flow velocity ranges.

Third Embodiment

Next, a third embodiment of the present invention will be described with reference to FIG. 4. In addition, the same components as those in the first embodiment and second embodiment described above are denoted by the same reference numerals, and a detailed description thereof will be omitted.

Figure 4:
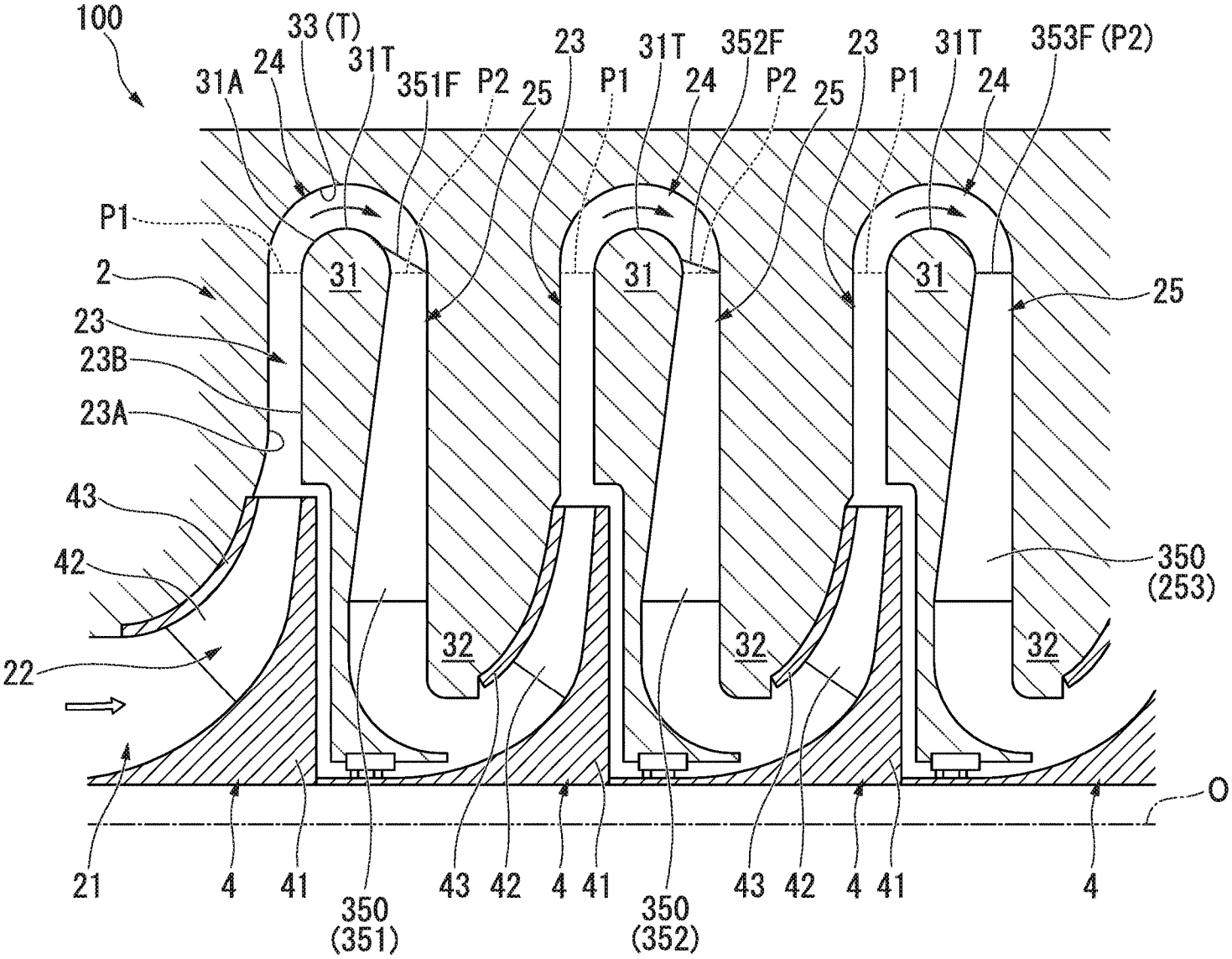
FIG. 4 is an enlarged cross-sectional view of an essential portion of a centrifugal compressor according to a third embodiment of the present invention.

As shown in FIG. 4, in the centrifugal compressor 300 according to the present embodiment, the leading edges 351F, 352F, and 353F of the return vanes 350 (the first return vane 351, the second return vane 352, and the third return vane 353) are all inclined with respect to the axis O. Further, the inclination of the leading edges 351F, 352F, and 353F gradually decreases from the first return vane 351 toward the third return vane 353.

More specifically, in the first return vane 351, an end portion of the leading edge 351F on one side (the upstream side) in the direction of the axis O is located on the outside in the radial direction as compared with the position P2. On the other hand, an end portion of the leading edge 351F on the other side (the downstream side) in the direction of the axis O is positioned on the upstream-side lateral wall 32A and at the same radial position as the position P2.

In the second return vane 352, an end portion of the leading edge 352F on one side in the direction of the axis O is located on the outside in the radial direction as compared with the position P2. Further, the end portion of the leading edge 352F on the other side in the direction of the axis O is located on the upstream-side lateral wall 32A at the same radial position as the position P2 and is located on the further inner side in the radial direction as compared with the end portion thereof on the one side in the direction of the axis O. Further, the inclination of the leading edge 352F with respect to the axis O is smaller than the inclination of the leading edge 351F of the first return vane 351 with respect to the axis O. In other words, in the leading edge 352F of the second return vane 352, a direction component along the axis O is larger than a leading edge 351F of the first return vane 351.

Further, in the third return vane 353, an end portion of the leading edge 353F on one side in the direction of the axis O is located at a radial position that is the same as the position P2. Further, an end portion of the leading edge 353F on the other side in the direction of the axis O is located on the upstream-side lateral wall 32A and at the same radial position as the position P2. Further, the inclination of the leading edge 353F with respect to the axis O is smaller than the inclination of the leading edge 351F of the first return vane 351 and the inclination of the leading edge 352F of the second return vane 352 with respect to the axis O. In other words, in the leading edge 353F of the third return vane 353, a direction component along the axis O is larger than that of the leading edge 351F and the leading edge 352F.

In addition, in the centrifugal compressor 300 according to the present embodiment, similar to the centrifugal compressor 100 in the first embodiment described above, the flow velocity of the fluid flowing through the flow path 2 increases (i.e., the mechanical Mach number is higher) in the compression stage on the upstream side, and the flow velocity decreases (i.e., the mechanical Mach number is lower) in the compression stage on the downstream side.

According to the above configuration, the inner peripheral-side end portion of the leading edge of the first return vane 351 is located on the side of the return bend portion 24, and the outer peripheral-side end portion is located on the inside in the radial direction as compared with the inner peripheral-side end portion. Thus, it is possible to more effectively suppress the separation of the flow on the inner peripheral side of the return bend portion 24 where the flow separation is most likely to occur and to sufficiently suppress the increase in the friction loss on the outer peripheral side.

In addition, since, in the subsequent return vane 350 in the downstream side, the inner peripheral-side end portion is located on the guide flow path 25 side, the separation of the flow can be suppressed on the upstream side and the friction loss on the downstream side can be suppressed in the centrifugal compressor 300 in which the mechanical Mach number is increased on the upstream side.

Further, according to the above configuration, since the leading edge of the return vane 350 extends so as to incline from the outside to the inside in the radial direction with respect to the axis O while directed toward the outer peripheral-side end portion from the inner peripheral-side end portion, it is possible to obtain a rectifying effect on the flow of the fluid on the inner peripheral side of the return bend portion 24.

Fourth Embodiment

Next, a fourth embodiment of the present invention will be described with reference to FIG. 5. In addition, the same components as those in the first embodiment, the second embodiment, and the third embodiment will be denoted by the same reference numerals, and detailed description thereof will be omitted.

Figure 5:
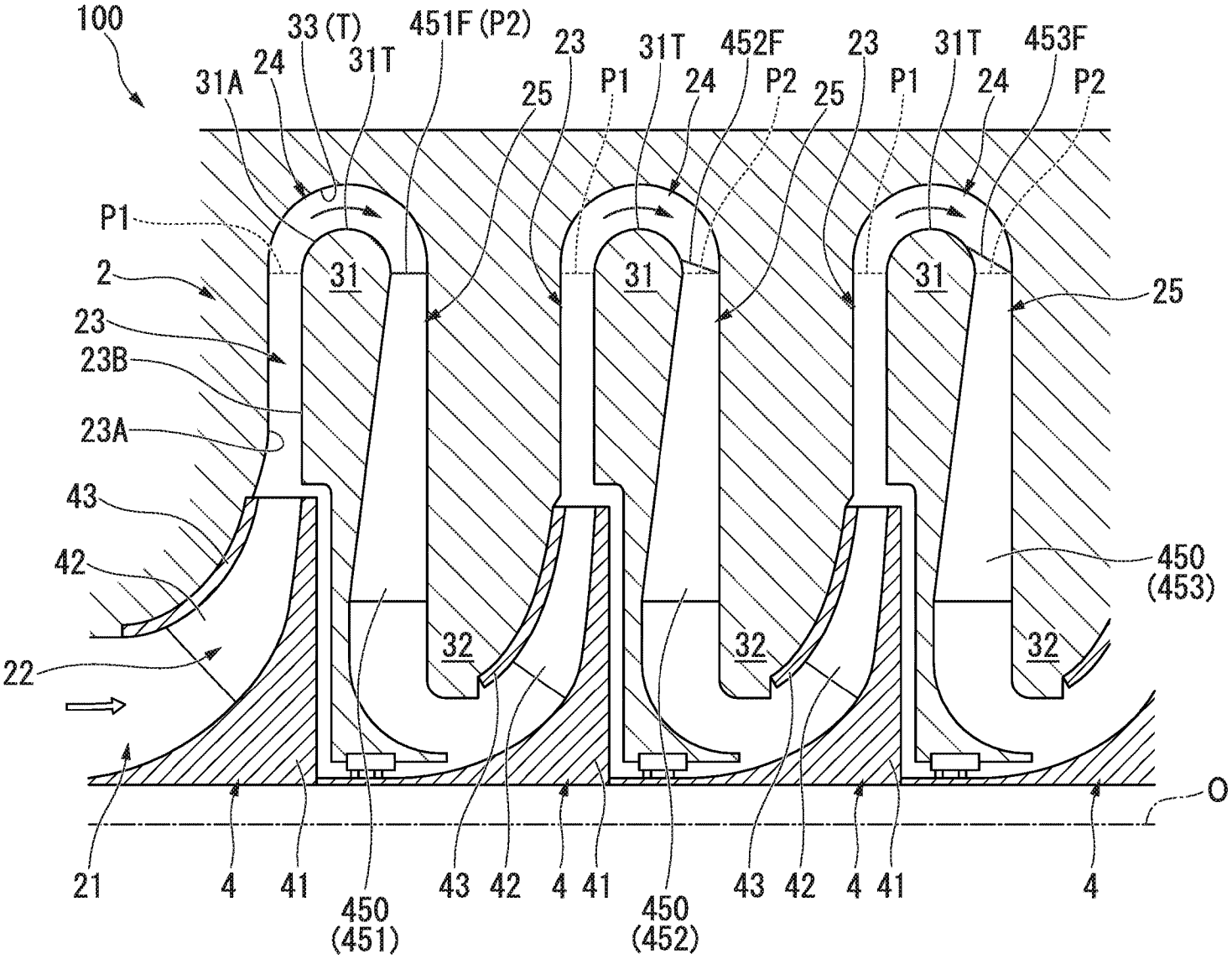
FIG. 5 is an enlarged cross-sectional view of an essential portion of a centrifugal compressor according to a fourth embodiment of the present invention.

As shown in FIG. 5, in the centrifugal compressor 400 according to the present embodiment, the leading edges 451F, 452F, and 453F of the return vanes 450 (the first return vane 451, the second return vane 452, and the third return vane 453) in the radial direction of the axis O are all inclined with respect to the axis O. Further, the inclination of the leading edges 451F, 452F, and 453F gradually increases from the first return vane 451 toward the third return vane 453.

More specifically, in the first return vane 451, an end portion of the leading edge 451F on one side in the direction of the axis O is located at the same radial position as the position P2. Further, an end portion of the leading edge 451F on the other side in the direction of the axis O is located on the upstream-side lateral wall 32A and at the same radial position as the position P2.

In the second return vane 452, an end portion of the leading edge 452F on one side in the direction of the axis O is located on the outside in the radial direction compared with the position P2. Further, an end portion of the leading edge 452F on the other side in the direction of the axis O is located on the upstream-side lateral wall 32A and at the same radial position as the position P2. Further, the inclination of the leading edge 452F with respect to the axis O is larger than the inclination of the leading edge 451F of the first return vane 451 with respect to the axis O. In other words, in the leading edge 452F of the second return vane 452, the direction component along the axis O is smaller than that of the leading edge 451F of the first return vane 451.

Further, in the third return vane 453, an end portion of the leading edge 453F on one side in the direction of the axis O is located on the outside in the radial direction as compared with the position P2. On the other hand, the end portion of the leading edge 453F on the other side in the direction of the axis O is located on the upstream-side lateral wall 32A and at the same radial position as the position P2. Further, the inclination of the leading edge 453F with respect to the axis O is larger than the inclination of the leading edge 451F of the first return vane 451 and the inclination of the leading edge 452F of the second return vane 452 with respect to the axis O. In other words, in the leading edge 453F of the third return vane 453, a direction component along the axis O is smaller than those of the leading edge 451F and the leading edge 452F.

In addition, in the centrifugal compressor 400 according to the present embodiment, the flow velocity of the fluid flowing through the flow path 2 gradually increases from the upstream side toward the downstream side (the mechanical Mach number increases).

According to the above configuration, in the subsequent return vane 450 in the other side in the direction of the axis O, the inner peripheral-side end portion of the leading edge of the return vane 450 is located on the return bend portion 24 side, and the outer peripheral-side end portion is located on the inside in the radial direction as compared with the inner peripheral-side end portion. As a result, it is possible to more effectively suppress the separation on the inner peripheral side of the return bend portion 24 where the separation of the flow is most likely to occur, and to sufficiently suppress an increase in the friction loss on the outer peripheral side.

In addition, since, in the subsequent return vane 450 in the other side in the direction of the axis O, the inner peripheral-side end portion is located on the side of the return bend portion 24, for example, in a centrifugal rotary machine in which the machine Mach number decreases on the downstream side, the friction loss can be suppressed on the upstream side and the separation of the flow can be suppressed on the downstream side.

Further, according to the above configuration, since the leading edge of the return vane 450 extends so as to incline from the outside to the inside in the radial direction with respect to the axis O while directed from the inner peripheral-side end portion toward the outer peripheral-side end portion, it is possible to obtain a rectifying effect on the flow of the fluid on the inner peripheral side of the return bend portion 24.

Various embodiments of the present invention have been described above with reference to the accompanying drawings. However, each of the above embodiments is merely an example, and various modifications can be made to these configurations.

For example, the number of compression stages of the centrifugal compressors 100, 200, 300, and 400 (i.e., the numbers of the impellers 4 and the flow paths 2) is not limited those described above in the embodiments, and may be appropriately set according to the design and the specification.

In addition, in the third embodiment and the fourth embodiment, an example in which the leading edges of the return vanes 350 and 450 are inclined linearly has been described. However, the shape of the leading edge of the return vanes 350 and 450 is not limited to those described above in the embodiments. As another example, each of the leading edges of the return vanes 350 and 450 may be formed in a curved shape that curves toward the inside in the radial direction. Also with such a configuration, it is possible to obtain the same operation and effect as those of the third and fourth embodiments.

INDUSTRIAL APPLICABILITY

The present invention provides a centrifugal rotary machine capable of sufficiently high efficiency in a wide flow velocity range.

EXPLANATION OF REFERENCE SIGN

1: Rotor
2: Flow path
3: Casing
4: Impeller
5: Journal bearing
6: Thrust bearing
7: Intake port
8: Exhaust port
21: Intake flow path
22: Compressing flow path
23: Diffuser flow path
23A: Diffuser front wall
23B: Diffuser rear wall
24: Return bend portion
25: Guide flow path
31: Partition wall member
31A: Outer peripheral wall
31B: Downstream-side lateral wall
31T: Outermost peripheral portion
32: Extension portion
32A: Upstream-side lateral wall
33: Inversion wall
41: Disk
42: Vane
43: Shroud
50, 250, 350, 450: Return vane
51, 251, 351, 451: First return vane
52, 252, 352, 452: Second return vane
53, 253, 353, 453: Third return vane
51F, 52F, 53F, 251F, 252F, 253F, 351F, 352F, 353F: Leading edge
50P: Protruding portion
100, 200, 300, 400: Centrifugal compressor
G: Working fluid
O: Axis
P1: Position

The invention claimed is:

1. A centrifugal rotary machine comprising:
a rotor rotating about an axis thereof;
a casing covering the rotor and forms a flow path;
a plurality of impellers, that are provided on the rotor, that are arranged in an axial direction and that are configured to feed a fluid suctioned from one side in the axial direction to the outside in the radial direction of the axis by rotating about the axis; and
flow paths, each of which are provided between the impellers adjacent to each other in the axial direction, and configured to guide the fluid discharged from an upstream impeller to a downstream impeller,
wherein each flow path includes:
a diffuser flow path extending from the inside to the outside in the radial direction of the axis and configured to guide the fluid discharged from the upstream impeller to the outside in the radial direction;
a return bend portion, one end of which is communicated with the diffuser flow path, and which is a curved flow path configured to guide the fluid guided by the diffuser flow path toward the inside in the radial direction;
a guide flow path communicated with the other end of the return bend portion and configured to guide the fluid guided by the return bend portion to the inside in the radial direction and to introduce the fluid to the impeller on the other side in the axial direction; and
a plurality of return vanes extending across the return bend portion and the guide flow path in the flow path and disposed at intervals in a circumferential direction of the axis,
wherein a leading edge of each of the return vanes in each flow path is positioned such that a radial position of the leading edge, with respect to a radial position of a top portion of an inner wall surface on the inside in the radial direction of each return bend portion, gradually changes in the radial direction along the axial direction, and
wherein, with respect to any of the return vanes, the radial position of the leading edge is closer to the radial position of the top portion of the inner wall surface than the radial position of the leading edge of any of the other return vanes disposed further upstream within the centrifugal rotary machine.

2. The centrifugal rotary machine according to claim 1, wherein the leading edge of each of the return vanes is parallel to the axis.

3. A centrifugal rotary machine comprising:
a rotor rotating about an axis thereof;
a casing covering the rotor and forms a flow path;
a plurality of impellers, that are provided on the rotor, that are arranged in an axial direction and that are configured to feed a fluid suctioned from one side in the axial direction to the outside in the radial direction of the axis by rotating about the axis; and flow paths, each of which are provided between the impellers adjacent to each other in the axial direction, and configured to guide the fluid discharged from an upstream impeller to a downstream impeller, wherein each flow path includes:

a diffuser flow path extending from the inside to the outside in the radial direction of the axis and configured to guide the fluid discharged from the upstream impeller to the outside in the radial direction;

a return bend portion, one end of which is communicated with the diffuser flow path, and which is a curved flow path configured to guide the fluid guided by the diffuser flow path toward the inside in the radial direction;

a guide flow path communicated with the other end of the return bend portion and configured to guide the fluid guided by the return bend portion to the inside in the radial direction and to introduce the fluid to the impeller on the other side in the axial direction; and a plurality of return vanes extending across the return bend portion and the guide flow path in the flow path and disposed at intervals in a circumferential direction of the axis, wherein a leading edge of each of the return vanes in each flow path is positioned such that a radial position of the leading edge, with respect to a radial position of a top portion of an inner wall surface on the inside in the radial direction of each return bend portion, gradually changes in the radial direction along the axial direction, wherein, with respect to any of the return vanes, an inner peripheral-side end portion of the leading edge is located closer to the guide flow path than the inner peripheral-side portion of the leading edge of any of the other return vanes disposed further upstream within the centrifugal rotary machine, and wherein an outer peripheral-side end portion of the leading edge of each of the return vanes is located on the outer peripheral side of the inner peripheral-side end portion is located on the inside in the radial direction as compared with the inner peripheral-side end portion with respect to the axis.

4. The centrifugal rotary machine according to claim 3, wherein the leading edge extends so as to incline from the outside to the inside in the radial direction with respect to the axis while directed toward the outer peripheral-side end portion from the inner peripheral-side end portion.

5. A centrifugal rotary machine comprising:

a rotor rotating about an axis thereof;

a casing covering the rotor and forms a flow path;

a plurality of impellers, that are provided on the rotor, that are arranged in an axial direction and that are configured to feed a fluid suctioned from one side in the axial direction to the outside in the radial direction of the axis by rotating about the axis; and flow paths, each of which are provided between the impellers adjacent to each other in the axial direction, and configured to guide the fluid discharged from an upstream impeller to a downstream impeller, wherein each flow path includes:

a diffuser flow path extending from the inside to the outside in the radial direction of the axis and configured to guide the fluid discharged from the upstream impeller to the outside in the radial direction;

a return bend portion, one end of which is communicated with the diffuser flow path, and which is a curved flow path configured to guide the fluid guided by the diffuser flow path toward the inside in the radial direction;

a guide flow path communicated with the other end of the return bend portion and configured to guide the fluid guided by the return bend portion to the inside in the radial direction and to introduce the fluid to the impeller on the other side in the axial direction; and a plurality of return vanes extending across the return bend portion and the guide flow path in the flow path and disposed at intervals in a circumferential direction of the axis, wherein a leading edge of each of the return vanes in each flow path is positioned such that a radial position of the leading edge, with respect to a radial position of a top portion of an inner wall surface on the inside in the radial direction of each return bend portion, gradually changes in the radial direction along the axial direction, wherein, with respect to any of the return vanes, an inner peripheral-side end portion of the leading edge is located closer to the return bend portion than the inner peripheral-side end portion of the leading edge of any of the other return vanes disposed further upstream within the centrifugal rotary machine, and wherein an outer peripheral-side end portion of the leading edge of each of the return vanes is located on the outer peripheral side of the inner peripheral-side end portion is located on the inside in the radial direction as compared with the inner peripheral-side end portion with respect to the axis.

6. The centrifugal rotary machine according to claim 5, wherein the leading edge extends so as to incline from the outside to the inside in the radial direction with respect to the axis while directed toward the outer peripheral-side end portion from the inner peripheral-side end portion.

* * * * *